US008333491B1

(12) United States Patent
Chou et al.

(10) Patent No.: US 8,333,491 B1
(45) Date of Patent: Dec. 18, 2012

(54) EMERGENCY LIGHT

(75) Inventors: Po-Wen Chou, New Taipei (TW); Shih-Jen Chuang, New Taipei (TW); Kee-Weng Lai, New Taipei (TW); Peng Hui Wang, New Taipei (TW); Chia-Te Chou, New Taipei (TW)

(73) Assignee: Ecolighting, Inc Corp., New Taipei (TW)

( * ) Notice: Subject to any disclaimer, the term of this patent is extended or adjusted under 35 U.S.C. 154(b) by 0 days.

(21) Appl. No.: 13/244,592

(22) Filed: Sep. 25, 2011

(51) Int. Cl.
*F21V 21/00* (2006.01)

(52) U.S. Cl. ..... 362/388; 362/190; 362/191; 362/183; 362/184

(58) Field of Classification Search ..... 362/183, 362/190, 191, 184, 802, 432, 388, 147
See application file for complete search history.

(56) References Cited

U.S. PATENT DOCUMENTS 2,588,772 A * 3/1952 Sill ..... 324/506
5,797,672 A 8/1998 Dobert
6,056,414 A 5/2000 Krieger
7,264,377 B2 * 9/2007 Cooper et al. ..... 362/276
2006/0034078 A1 2/2006 Kovacik et al.
2007/0291477 A1 * 12/2007 Khubani ..... 362/191
2008/0174991 A1 7/2008 Tucker
2010/0277899 A1 * 11/2010 Peak ..... 362/183

FOREIGN PATENT DOCUMENTS

CN 201416857 Y 3/2010

OTHER PUBLICATIONS

European Search Report.

* cited by examiner

*Primary Examiner* — Laura Tso
(74) *Attorney, Agent, or Firm* — Chun-Ming Shih; HDLS IPR Services

(57) ABSTRACT

The emergency light of the invention includes a base (1), a lighting module (2), a rechargeable battery (3) and a retractable support (4). The base (1) has a back (11) with a trough (111). The lighting module (2) is installed in the base (1) and electrically connects a lighting device (21) and a circuit board (22). The rechargeable battery (3) is installed in the base (1) and electrically connects the circuit board (22). The retractable support (4) is pivotally connected to the back (11) and received in the trough (111).

13 Claims, 10 Drawing Sheets

EMERGENCY LIGHT

BACKGROUND OF THE INVENTION

1. Technical Field

The invention relates to lighting devices, particularly to emergency lights.

2. Related Art

An emergency light is a battery-backed lighting device that comes on automatically when a building experiences a power outage.

Generally, a conventional emergency light includes a housing, a rechargeable battery, a circuit board and a lighting device. The rechargeable battery is charged when the electric power is normal, and the rechargeable battery will power the lighting device when the electric power stops.

However, such an emergency light is not so convenient because it is usually mounted on a wall for unvaryingly local lighting. In other words, conventional emergency lights cannot be carried to be used anywhere. On the other hand, conventional emergency lights cannot provide any function when the electric power is normal. There should be a solution which can expand usability of emergency lights.

SUMMARY OF THE INVENTION

An object of the invention is to provide an emergency light with a retractable support, which is easy to be carried and enhances usability.

To accomplish the above object, the emergency light of the invention includes a base, a lighting module, a rechargeable battery and a retractable support. The base has a back with a trough. The lighting module is installed in the base and electrically connects a lighting device and a circuit board. The rechargeable battery is installed in the base and electrically connects the circuit board. The retractable support is pivotally connected to the back and received in the trough.

DETAILED DESCRIPTION OF THE INVENTION

Figure 1:
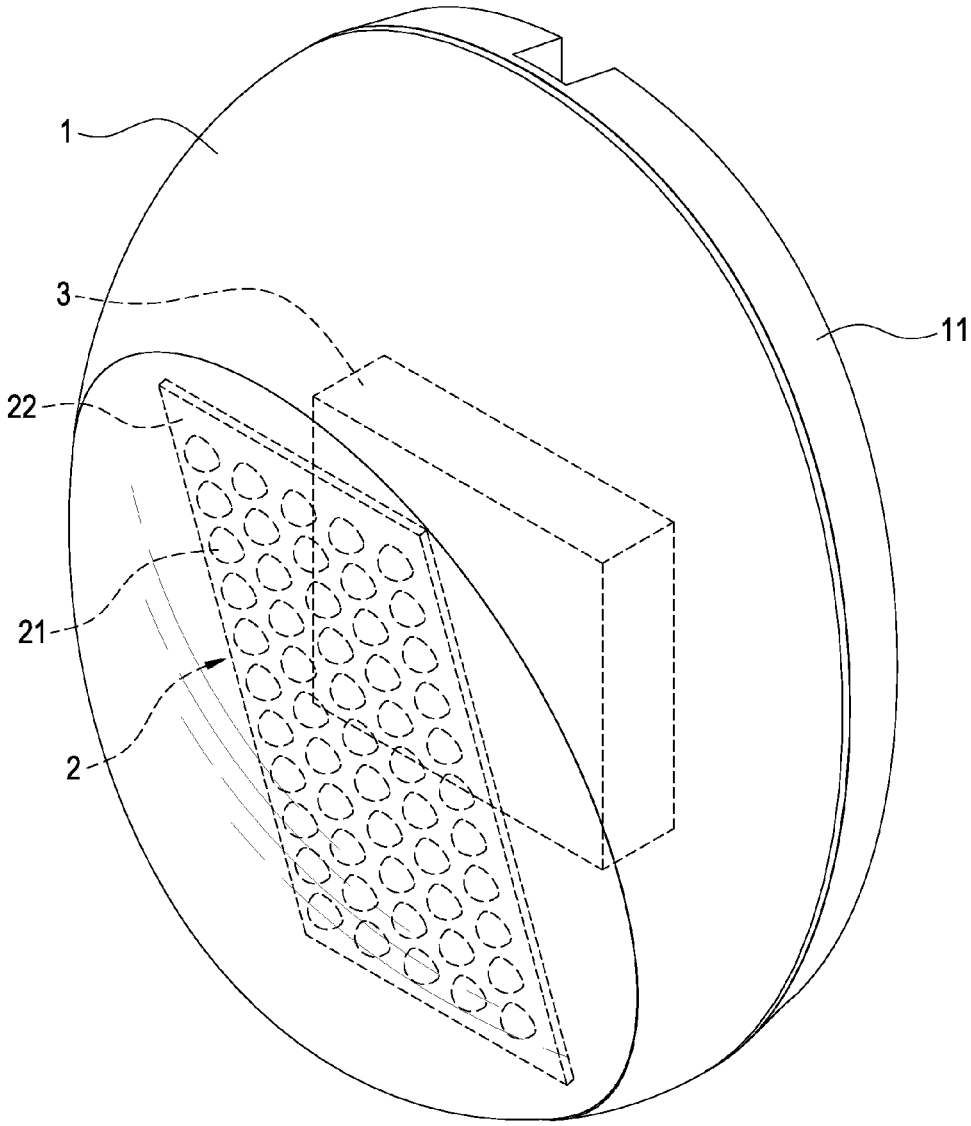
FIG. 1 is a schematic view of the invention.
Figure 2:
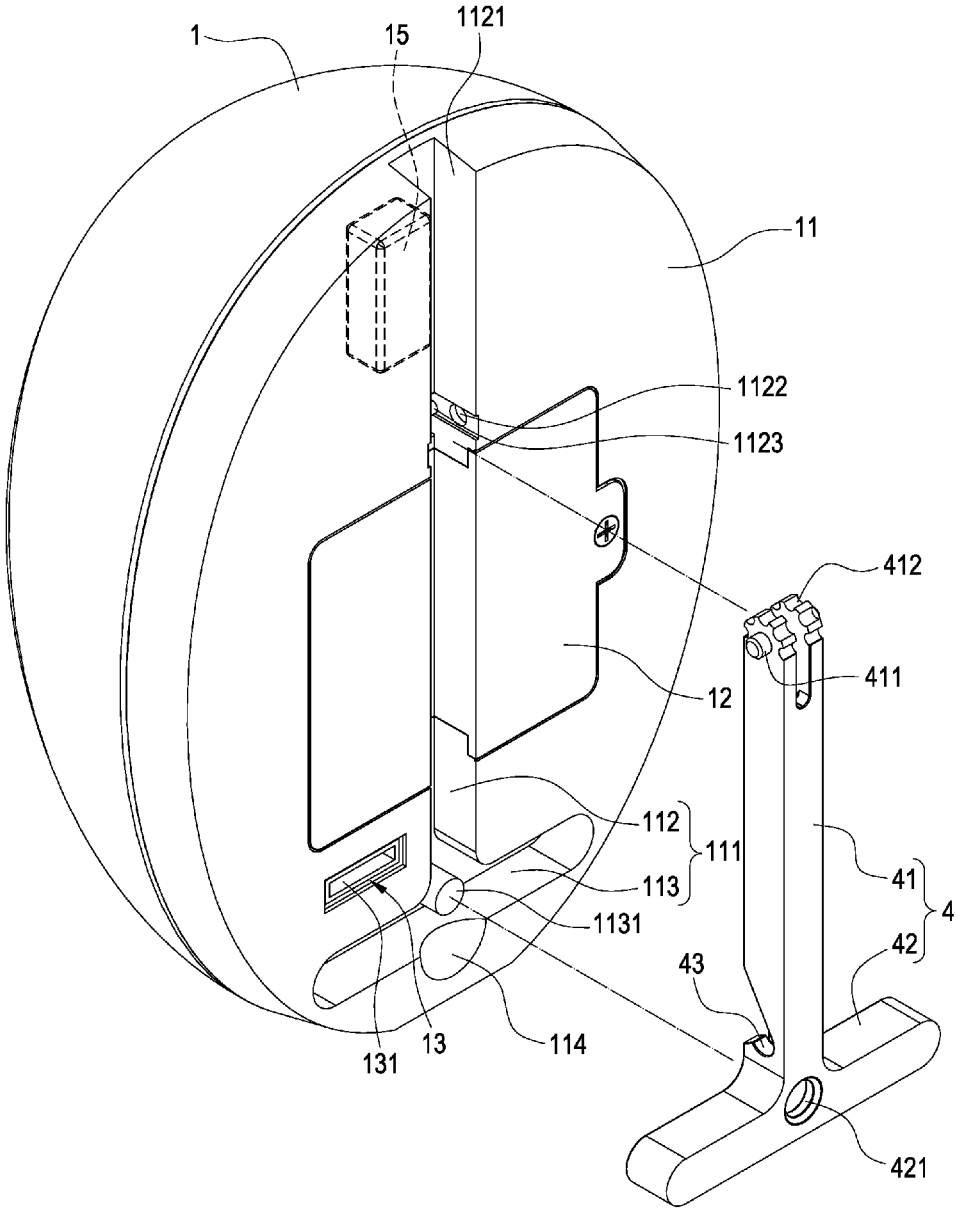
FIG. 2 is an exploded view of the invention.
Figure 3:
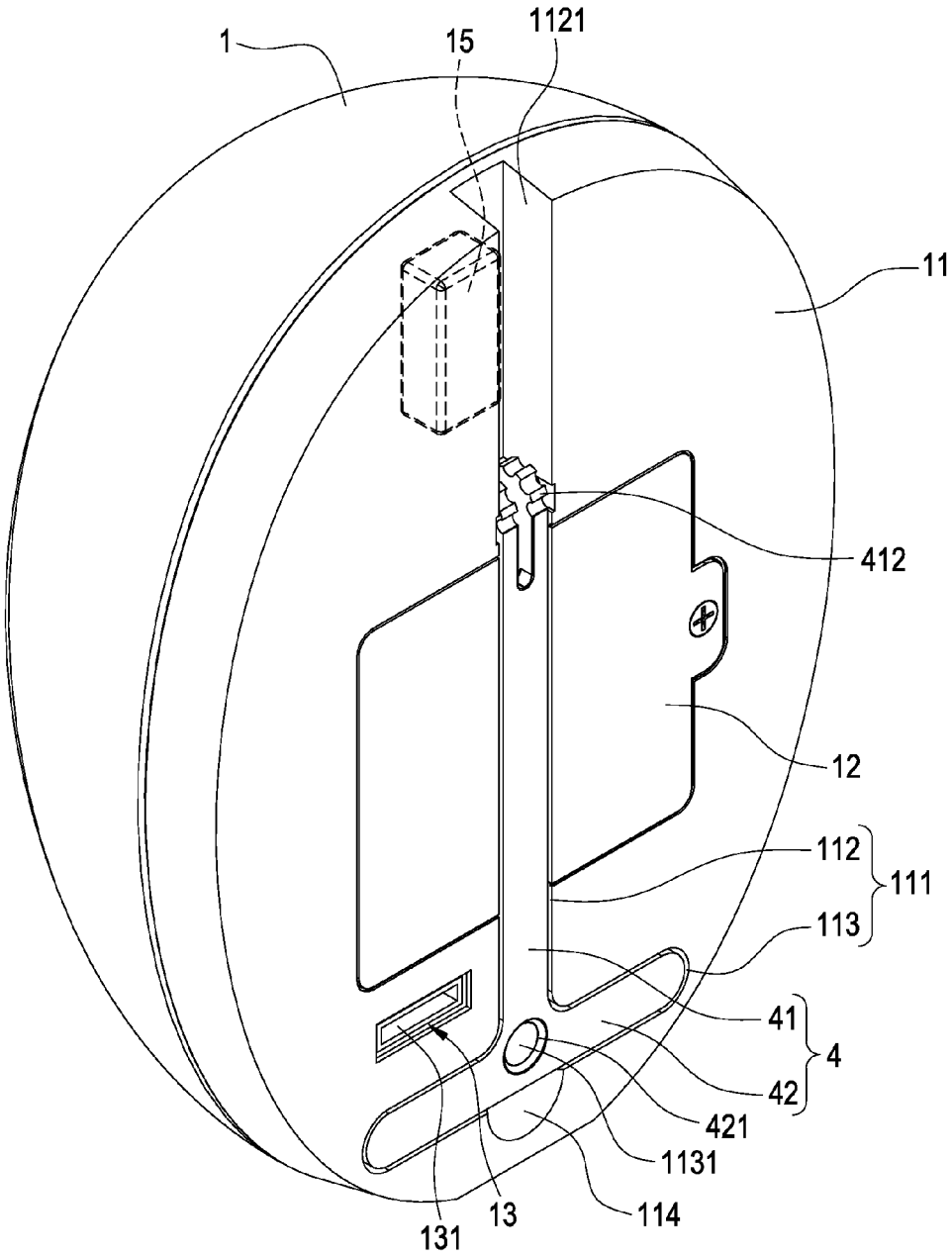
FIG. 3 is an assembled view of the invention.
Figure 4:
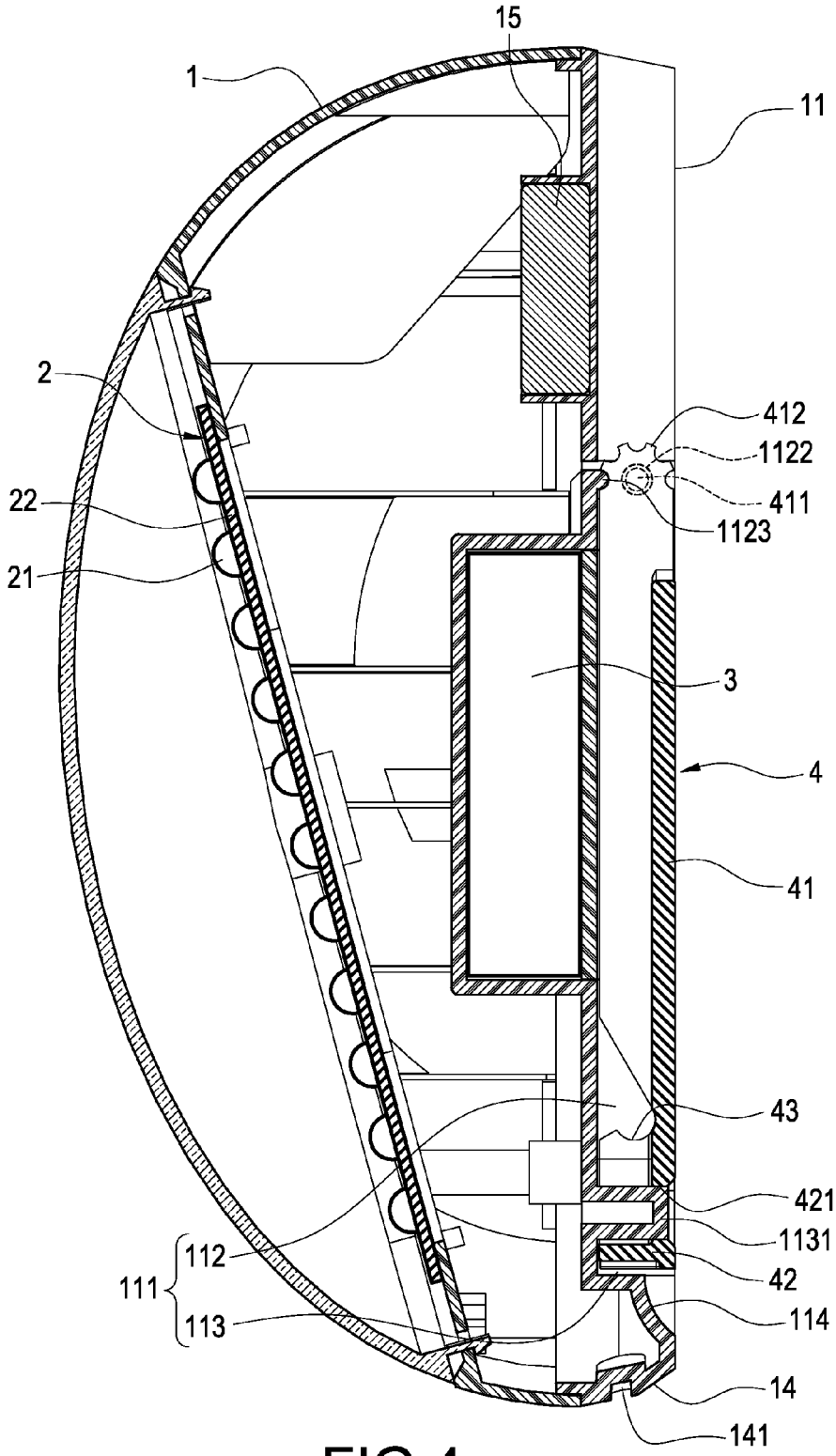
FIG. 4 is a cross-sectional view of the invention.

Please refer to FIGS. 1-4. The emergency light of the invention includes a base 1, a lighting module 2, a rechargeable battery 3 and a retractable support 4.

The base 1 has a back 11 with a trough 111. The trough 111 is composed of a longitudinal portion 112 and a transverse portion 113. Two side walls 1121 are formed in the longitudinal portion 112 and with two corresponding pivot holes 1122. The longitudinal portion 112 and the transverse portion

113 are formed with a protrusion 1123 and a post 1131, respectively. The back 11 is provided with a recess 114 communicating with the transverse portion 113. Additionally, the invention further includes a battery cover 12, and the longitudinal portion 112 is also formed in the battery cover 12.

The lighting module 2 is installed in the base 1 and electrically connects a lighting device 21 and a circuit board 22. The lighting device 21 may be a light emitting diode.

The rechargeable battery 3 is installed in the base 1 and electrically connects the circuit board 22. The rechargeable battery 3 is covered by the battery cover 12 and may be replaced by opening the battery cover 12.

The retractable support 4 is pivotally connected in the trough 111 of the back 11. The retractable support 4 is of a T-shape composed of a longitudinal rod 41 and a transverse rod 42. The longitudinal rod 41 and transverse rod 42 may be received in the longitudinal portion 112 and the transverse portion 113 of the trough 111, respectively. The longitudinal rod 41 is formed with a pivot 411 rotatably received in the pivot holes 1122 and a gear portion 412 engaging with the protrusion 1123. The middle of the transverse rod 42 is provided with a through hole 421 for being inserted by the post 1131. Additionally, the retractable support 4 is formed with a hanging portion 43 of a U-shape.

Figure 5:
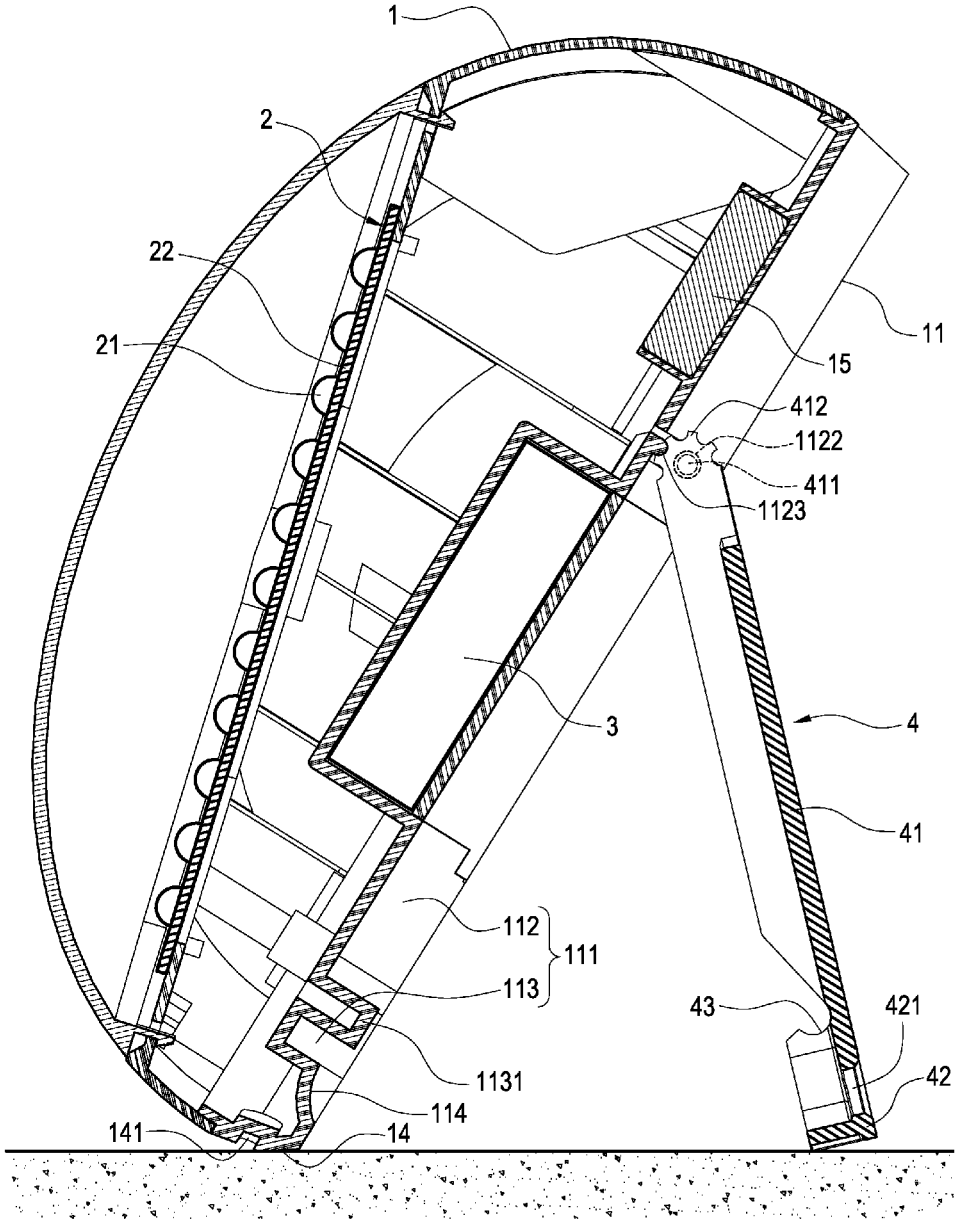
FIG. 5 shows a using status of the retractable support of the invention.
Figure 6:
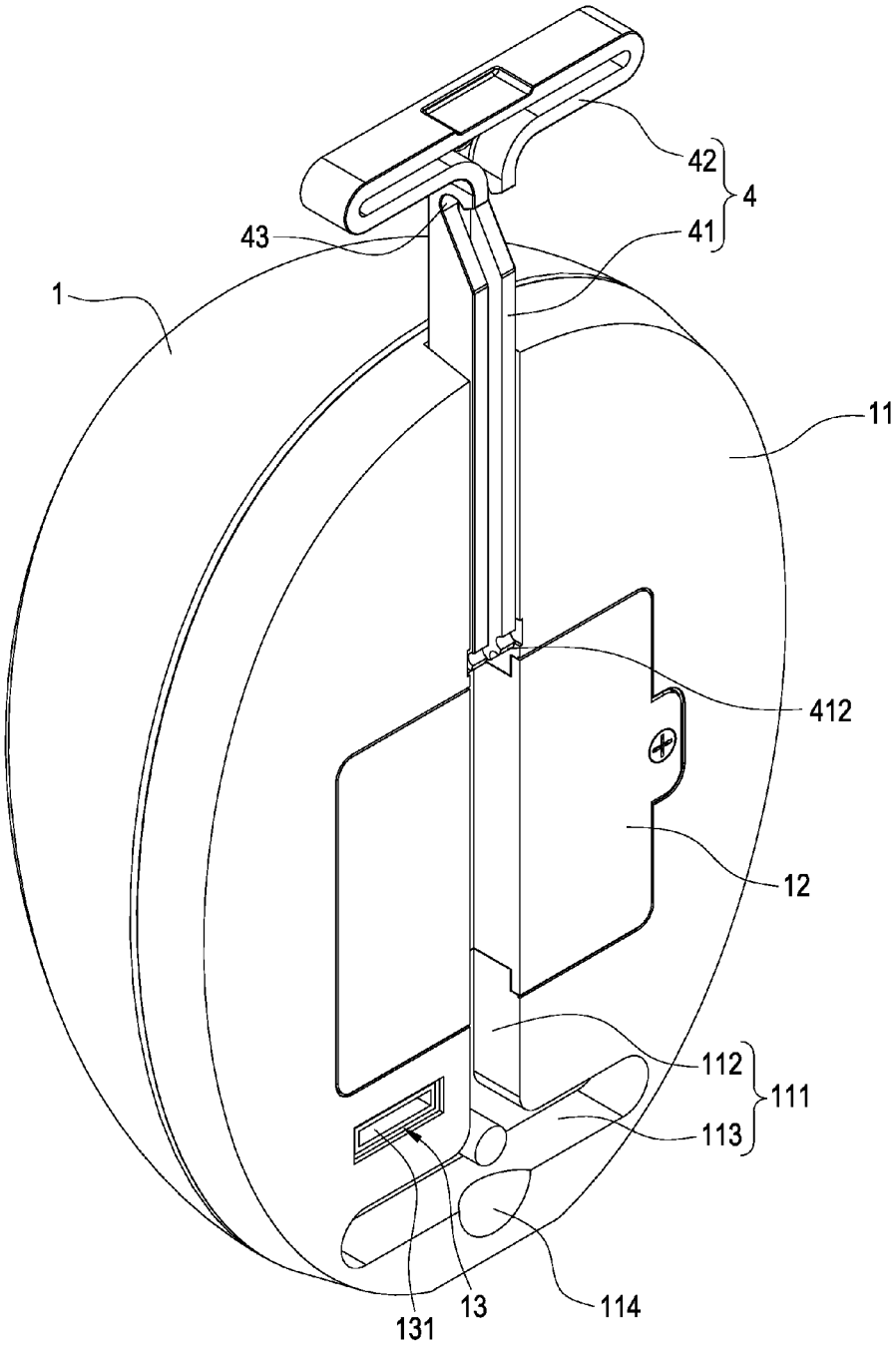
FIG. 6 shows another using status of the retractable support of the invention.

Please refer to FIGS. 5 and 6. The retractable support 4 can be rotated about the pivot 411 in a range of 180 degrees. By means of the engagement between the gear portion 412 and the protrusion 1123, the retractable support 4 can also be divisionally positioned when rotating. When the retractable support 4 is positioned at about 30-60 degrees against the back 11, the emergency light can be placed on a table as shown in FIG. 5.

Figure 7:
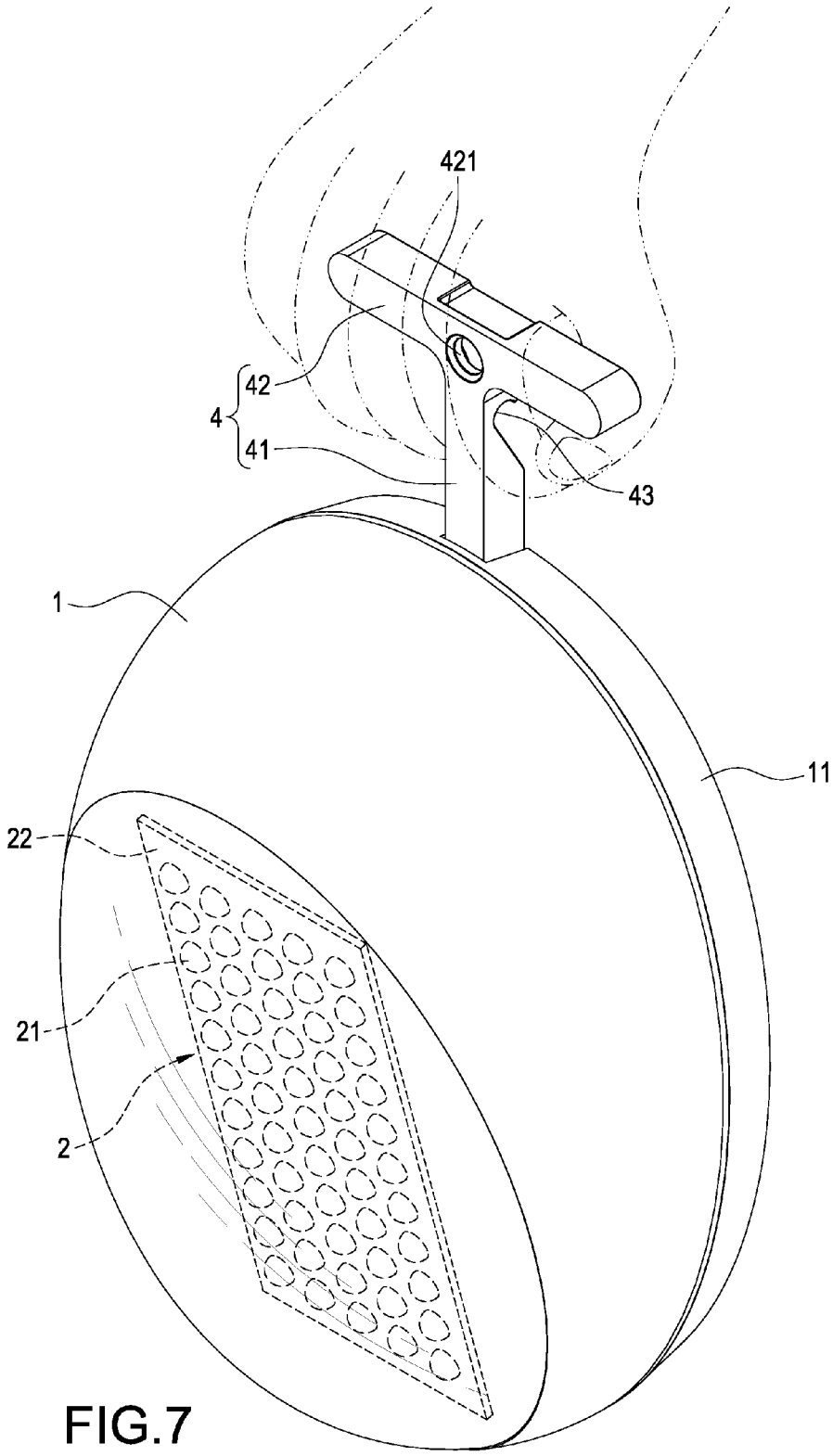
FIG. 7 shows still another using status of the retractable support of the invention.

Please refer to FIGS. 6 and 7. When the retractable support 4 is rotated 180 degrees to be positioned upwards, the transverse rod 42 may be held by a user. This is helpful to carry the emergency light.

Figure 8:
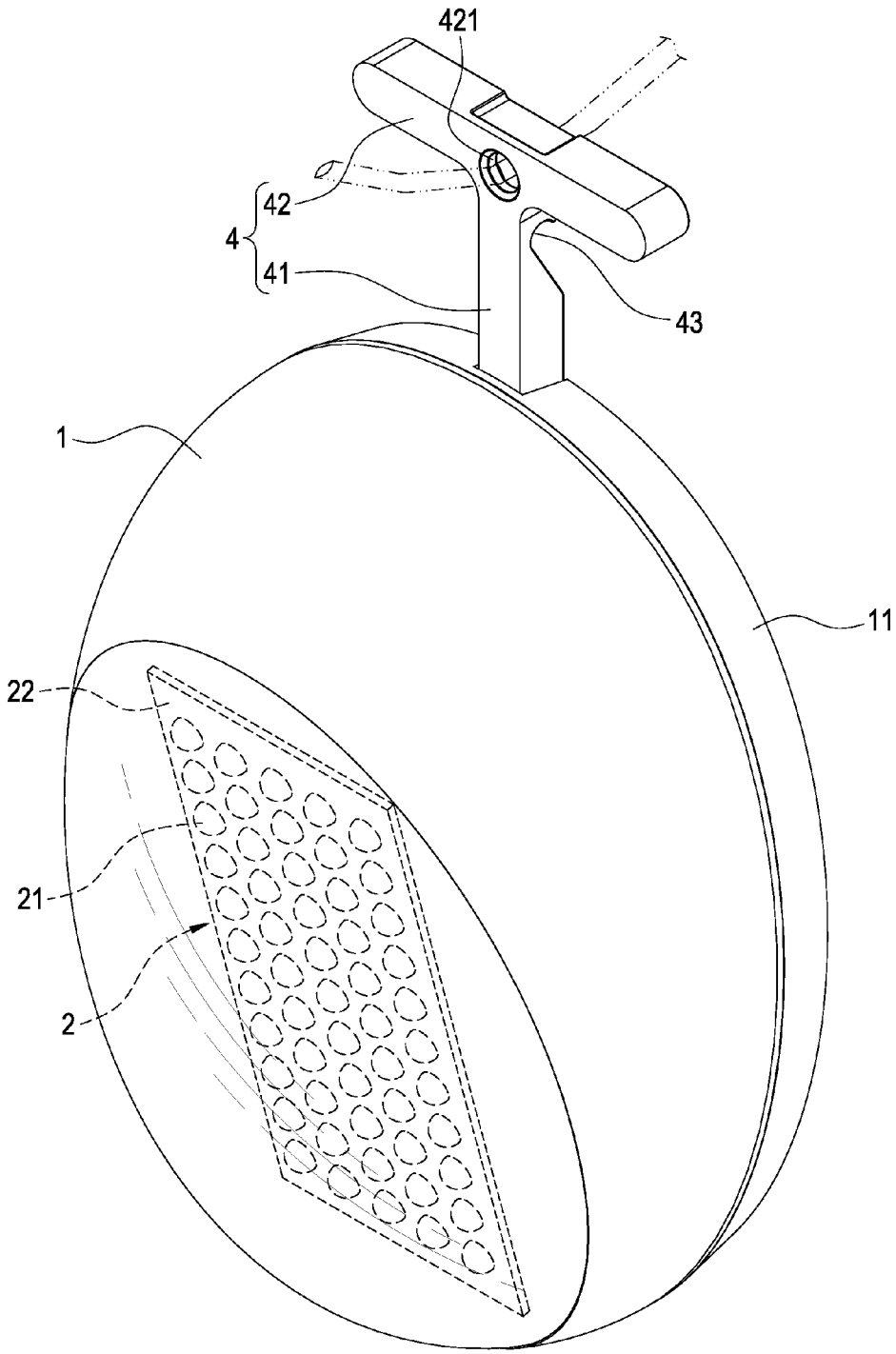
FIG. 8 shows yet another using status of the retractable support of the invention.

Please refer to FIG. 8. The through hole 421 may be passed by a cord for fastening. The hanging portion 43 is helpful to hang up the emergency light.

Figure 9:
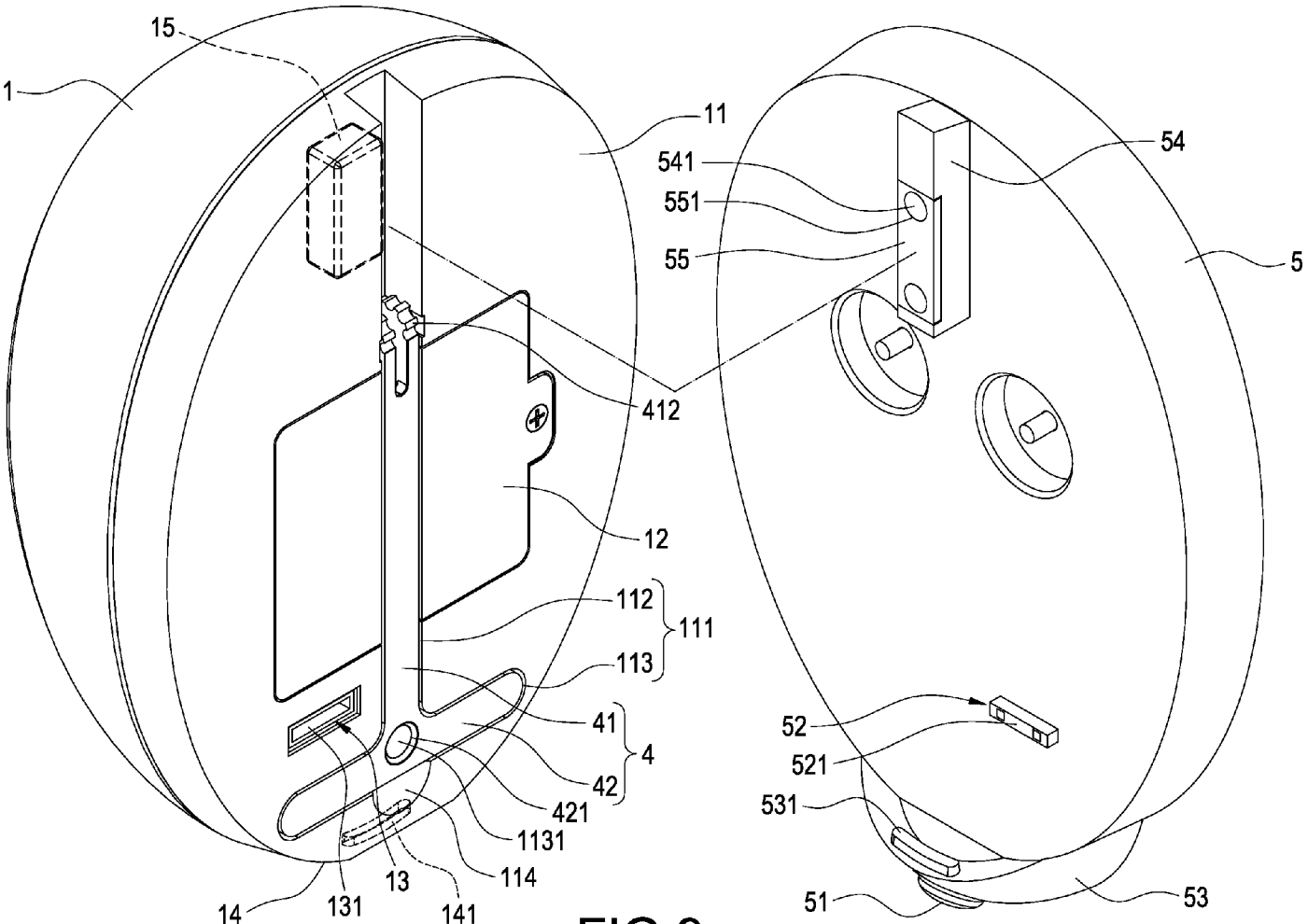
FIG. 9 is an exploded view of the invention with a mount.
Figure 10:
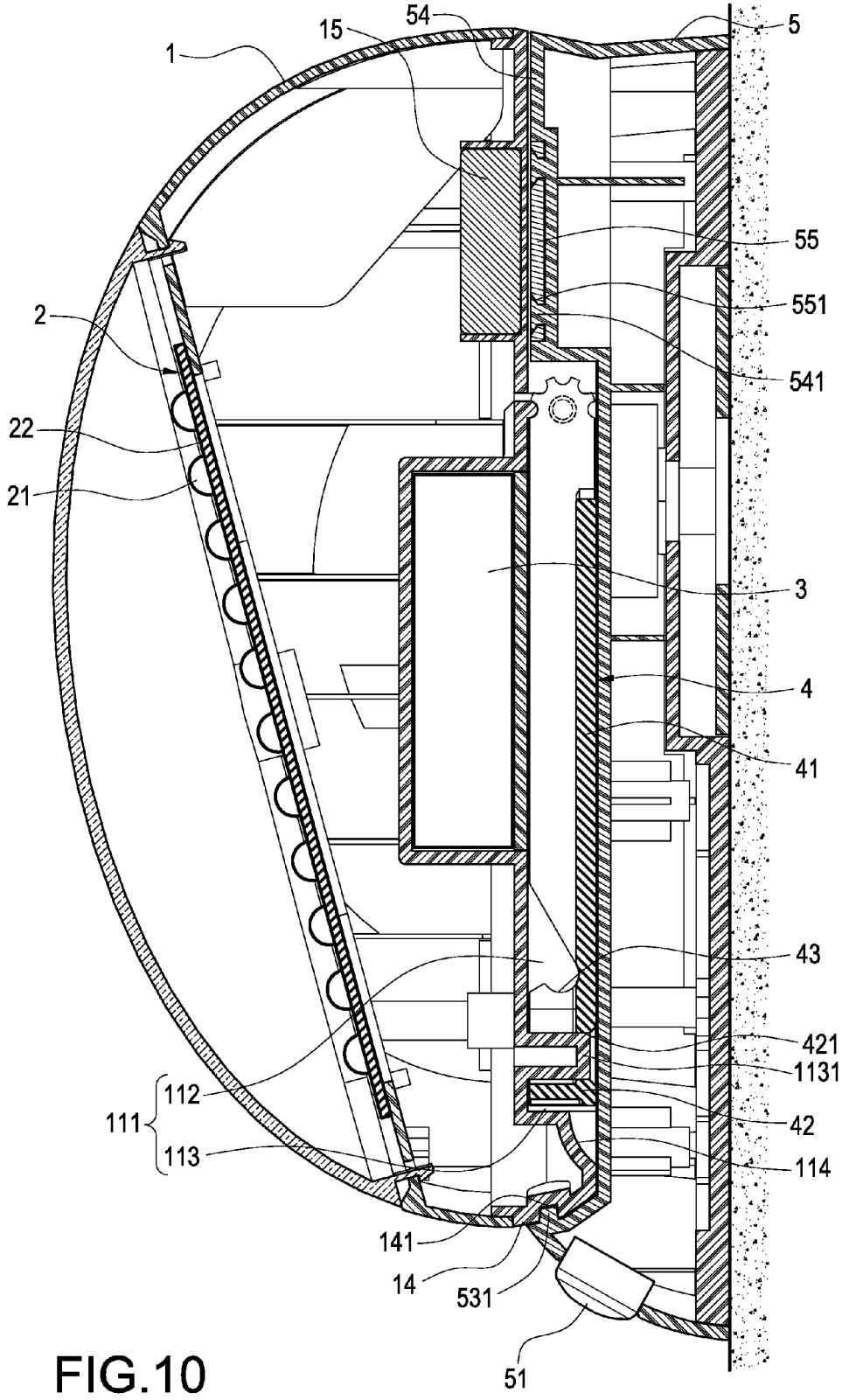
FIG. 10 is a cross-sectional view of the invention with the mount.

Please refer to FIGS. 9 and 10. The invention further provides a mount 5. The back 11 is provided with a first connecting portion 13 and a first magnetic element 15. The bottom 14 of the back 11 is formed with a concavity 141.

The base 1 may be fastened on the mount 5. There is an infrared detector 51 and a second connecting portion 52 electrically connected thereto in the mount 5. T5:55 PMhe first connecting portion 13, which may be a socket 131, is connected to the second connecting portion 52, which may be a plug 521. The mount 5 has a second magnetic element 55 corresponding to the first magnetic element 15. A bar 54 corresponding to the trough 111 is arranged on the mount 5 and formed with a bump 541. The second magnetic element 55 is provided with an engagement hole 551 so that the second magnetic element 55 is fixed on the bar 54 by embedding the bump 541 into the engagement hole 551. The first magnetic element 15 is located to near the bar 54. The bottom of the mount 5 is disposed with a projection 53 for connecting the bottom 14. The projection 53 is formed with a block 531 embedded into the concavity 141. The infrared detector 51 is fixed on the projection 53.

The lighting device 21 can be switched by the infrared detector when the base 1 is fastened on the mount 5. The base 1 is fastened on the mount 5 by the magnetic force between the two magnetic elements 15, 55 and embedding the block into the concavity 141.

The plug 521 is used to connect a wall outlet. The rechargeable battery 3 is charged when the electric power is normal, and the rechargeable battery 3 will power the lighting device 21 to light up.

Additionally, the rechargeable battery 3 will discharge to make the lighting device 21 light up when the infrared detector 51 is triggered by a person who nears. When the rechargeable battery 3 is being charged, the external current provides electricity to the rechargeable battery 3. The plug 521 stops providing the external current to the rechargeable battery 3 when the rechargeable battery 3 has been fully charged. At this time, the rechargeable battery 3 will power the lighting device 21 to light up. In other words, the emergency light of the invention can function as an infrared-controlled light when the electric power is normal.

On the other hand, the plug 521 and socket 131 can avoid using wires. This can simplify the structure of emergency light.

It will be appreciated by persons skilled in the art that the above embodiments have been described by way of example only and not in any limitative sense, and that various alterations and modifications are possible without departure from the scope of the invention as defined by the appended claims.

What is claimed is:

1. An emergency light comprising:

a base (1) having a back (11) with a trough (111);

a lighting module (2), installed in the base (1), and electrically connecting a lighting device (21) and a circuit board (22);

a rechargeable battery (3), installed in the base (1), and electrically connecting the circuit board (22); and a retractable support (4) pivotally connected to the back (11) and selectively received in the trough (111), wherein the retractable support (4) is of a T-shape composed of a longitudinal rod (41) and a transverse rod (42), and the trough (111) is correspondingly formed with a longitudinal portion (112) and a transverse portion (113) for receiving the longitudinal rod (41) and the transverse rod (42) respectively.

2. The emergency light of claim 1, wherein two side walls (1121) are formed in the longitudinal portion (112) and formed with two corresponding pivot holes (1122), and the longitudinal rod (41) is formed with a pivot (411) rotatably received in the pivot holes (1122).

3. The emergency light of claim 1, wherein the longitudinal rod (41) is formed with a gear portion (412) engaging with a protrusion (1123) formed on the longitudinal portion (112) of the trough (111).

4. The emergency light of claim 1, wherein the transverse rod (42) is provided with a through hole (421) for being inserted by a post (1131) formed in the transverse portion 113 of the trough (111).

5. The emergency light of claim 1, wherein the back (11) is provided with a recess (114) communicating with the transverse portion (113) of the trough (111).

6. The emergency light of claim 1, further comprising a battery cover (12) disposed on the back (11), wherein the longitudinal portion (112) of the trough (111) is also formed in the battery cover (12).

7. The emergency light of claim 1, wherein the retractable support (4) is formed with a hanging portion (43) of a U-shape.

8. An emergency light comprising:

a base (1) having a first connecting portion (13) and a back (11) with a trough (111) and;

a lighting module (2), installed in the base (1), and electrically connecting a lighting device (21) and a circuit board (22);

a rechargeable battery (3), installed in the base (1), and electrically connecting the circuit board (22);

a retractable support (4) pivotally connected to the back (11) and selectively received in the trough (111); and a mount (5), fastened by the base (1), having an infrared detector (51) and a second connecting portion (52) electrically connected thereto, wherein the first connecting portion (13) is connected to the second connecting portion (52), and the rechargeable battery (3) powers the circuit board (22) when the infrared detector (51) is triggered.

9. The emergency light of claim 8, wherein the first connecting portion (13) is a socket (131) and the second connecting portion (52) is a plug (521).

10. The emergency light of claim 9, wherein the back (11) is provided with a first magnetic element (15), the mount (5) has a second magnetic element (55) corresponding thereto.

11. The emergency light of claim 10, wherein a bar (54) corresponding to the trough (111) is arranged on the mount (5) and formed with a bump (541), the second magnetic element (55) is provided with an engagement hole (551) so that the second magnetic element (55) is fixed on the bar (54) by embedding the bump (541) into the engagement hole (551), and the first magnetic element (15) is located to near the bar (54).

12. The emergency light of claim 9, wherein the back (11) has a bottom (14) with a concavity (141), the mount (5) is disposed with a projection (53) for connecting the bottom (14), the projection (53) is formed with a block (531) embedded into the concavity (141).

13. The emergency light of claim 12, wherein the infrared detector (51) is fixed on the projection (53).

* * * * *